US006523281B1

(12) United States Patent
Lennihan, Jr.

(10) Patent No.: US 6,523,281 B1
(45) **Date of Patent: *Feb. 25, 2003**

(54) FOOTWEAR FOR HEEL STRIKERS

(76) Inventor: Richard Lennihan, Jr., 3317 Heritage Dr., Wilmington, DE (US) 19808

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 18 days.

This patent is subject to a terminal disclaimer.

(21) Appl. No.: 09/224,649

(22) Filed: Dec. 31, 1998

Related U.S. Application Data

(63) Continuation-in-part of application No. 08/719,685, filed on Sep. 26, 1996, now Pat. No. 5,875,568.

(51) Int. Cl.[7] ..... A43B 13/18; A43B 21/26; A43B 21/32; A43B 13/22

(52) U.S. Cl. ..... 36/28; 36/32 R; 36/114; 36/59 C; 36/37; 36/35 R; 36/25 R

(58) Field of Search ..... 36/28, 32 R, 114, 36/59 C, 37, 35, 25 R, 31, 35 R, 59 R, 30 R, 132, 103, 110, 129

(56) References Cited

U.S. PATENT DOCUMENTS

| | | | | |
|---|---|---|---|---|
| 532,429 | A | 1/1895 | Rogers | |
| 1,587,377 | A | 6/1926 | Grosjean | |
| 2,124,986 | A | 7/1938 | Pipes | 36/35 R |
| 2,162,912 | A | 6/1939 | Craver | 36/59 C |
| D201,952 | S | 8/1965 | Johns et al. | |
| 3,785,646 | A | 1/1974 | Ruskin et al. | 272/57 |
| 4,179,826 | A | 12/1979 | Davidson | 36/69 |
| 4,241,523 | A | 12/1980 | Daswick et al. | 36/30 |
| 4,262,435 | A | 4/1981 | Block et al. | 36/129 |
| 4,314,413 | A | 2/1982 | Dassler et al. | 36/129 |
| 4,316,335 | A | 2/1982 | Giese et al. | 36/129 |
| 4,348,821 | A | 9/1982 | Daswick | 36/103 |
| 4,364,188 | A | 12/1982 | Turner et al. | 36/31 |

(List continued on next page.)

FOREIGN PATENT DOCUMENTS

| | | | |
|---|---|---|---|
| EP | 346 298 | 6/1989 | 36/132 |

*Primary Examiner*—Anthony D. Stashick
(74) *Attorney, Agent, or Firm*—Connolly Bove Lodge & Hutz LLP

(57) ABSTRACT

Footwear for a human foot containing an elongated sole piece having a front, middle and rear section and having a ground engaging bottom surface and an upper surface in which the wearer's foot is received and, an upper piece secured to said sole piece, said upper piece providing an enclosed embracing foot enclosure having a counter section at the rear of the foot, a mid-body section, and a toe box section at the front, wherein said sole piece has a curved sole at the rear section of the sole to permit the user's foot to be tilted forward to enhance the power of the push when the user's foot makes contact with ground when the user strikes at the user's heel. In addition, the shoe can have an improved tread design and a removable and replaceable shock absorbing insert. The shoe preferably employs the principle of energy conversion.

19 Claims, 3 Drawing Sheets

U.S. PATENT DOCUMENTS

| | | | | | |
|---|---|---|---|---|---|
| 4,364,190 | A | | 12/1982 | Yonkers | 36/32 |
| 4,372,059 | A | | 2/1983 | Ambrose | 36/32 |
| 4,557,059 | A | | 12/1985 | Misevich et al. | 36/32 |
| 4,614,046 | A | | 9/1986 | Dassler | 36/30 |
| 4,631,842 | A | | 12/1986 | Koskela | 36/103 |
| 4,724,622 | A | * | 2/1988 | Mills | 36/30 R |
| 4,741,114 | A | | 5/1988 | Stubblefeld et al. | 36/32 |
| 4,817,304 | A | * | 4/1989 | Parker et al. | 36/114 |
| 4,876,806 | A | * | 10/1989 | Robinson et al. | 36/114 |
| 4,945,659 | A | | 8/1990 | DeMarchi et al. | 36/117 |
| 4,956,927 | A | | 9/1990 | Misveich et al. | 36/32 |
| 4,970,807 | A | | 11/1990 | Anderie' et al. | 36/28 |
| 5,036,604 | A | | 8/1991 | Rosen et al. | 36/88 |
| 5,086,574 | A | | 2/1992 | Bacchiocchi et al. | 36/35 |
| 5,088,481 | A | * | 2/1992 | Darby | 36/110 |
| 5,092,060 | A | | 3/1992 | Frachey et al. | 36/29 |
| 5,282,288 | A | | 2/1994 | Henson et al. | 12/142 |
| 5,331,750 | A | | 7/1994 | Sasaki et al. | 36/28 |
| 5,369,896 | A | | 12/1994 | Frachey et al. | 36/29 |
| 5,390,430 | A | | 2/1995 | Fitchmun et al. | 36/30 |
| 5,437,110 | A | | 8/1995 | Goldston et al. | 36/38 |
| 5,491,909 | A | * | 2/1996 | Darby | 36/110 |
| 5,513,448 | A | | 5/1996 | Lyons et al. | 36/28 |
| 5,537,762 | A | | 7/1996 | Walters et al. | 36/28 |
| 5,761,834 | A | * | 6/1998 | Grim et al. | 36/110 |
| 5,827,210 | A | * | 10/1998 | Antar et al. | 36/110 |

* cited by examiner

FOOTWEAR FOR HEEL STRIKERS

RELATED APPLICATIONS

This application is a continuation-in-part of Ser. No. 08/719,685 filed Sep. 26, 1996, and incorporates Ser. No. 08/719,685 U.S. Pat. No. 5,875,568 by reference in its entirety for all purposes.

BACKGROUND OF THE INVENTION

This invention describes an imaginative new footwear design based on the principle of energy conversion. The inventive footwear will make walking and running smoother, easier, more efficient, quicker, and simultaneously will reduce injuries arising from impact forces.

All walkers and runners fit in two simple categories, those who land on their heels and those who land on their toes. Although the term "runner" is used throughout the specification, it is noted that the term "runner" could also be a person walking and not running ("walker").

Heel runners: These, known also as "heel strikers", land on the back portion of their heel, roll forward on the outer side of the foot, and push off from the toe-forefoot area. The "striking" occurs in a relatively small region at the rear and outside of the heel. The impact of force or pressure of landing is calculated in pounds per square inch. That is, the weight of the runner multiplied by the impact area in square inches (small; say one half by one inch). The resulting impact pressure or force is large, often awesome. Since the descent of the foot on hitting the ground stops abruptly, in fact almost instantaneously, the law of "equal opposite forces" dictates that an equal pressure or force is transmitted in the opposite direction, back up the leg from foot to ankle to knee to hip. Taken over time, this jolt in distance runners (30 miles or more a week) causes predictable wear and tear problems involving foot, ankle, knee, hip and even back. This is the source of most injuries in distance runners. In addition, most "heel strikers" land with center of gravity slightly behind the point of impact, hence some of the reactive force up the leg actually pushes them backward. The runner locks the knee and "pogo-sticks" over the foot before rolling forward to the push-off position. This is inefficient, wasteful of energy, and tiring while causing a small though real slowing of the runner's forward progress.

Toe Runners: The other, smaller group of runners land on their toes or actually their forefoot areas. The point of impact is more apt to be under or modestly behind their center of gravity. The knee is slightly bent and absorbs some reactive energy. This style propels the runner forward, is more efficient, less tiring, and less prone to injuries. This group tends to be the sprinters and the elite distance runners.

All shoes are basically the same. Tops to cover the foot and keep the bottoms in place. Bottoms to protect the sole and to provide cushioning to absorb impact pressures.

Over recent years, shoe manufacturers have developed a variety of materials to reduce impact pressures through principles of compression and dispersion to absorb energy. Thus, modifications in design and composition of the heels (sponges, inserts, treads, air, and gels) and forefoot (sponges, inserts, and treads). All shoes employ the same principles with only a variation in theme. Thus the following:

U.S. Pat. No. 4,616,335 describes an athletic shoe structure including shock absorbing portions in the heel and foot areas of the sole of the shoe as well as particular placement of flexible nubs on the soft area.

U.S. Pat. No. 4,348,821 is directed towards the development of a shoe sole construction that will be mechanically effective for walking, running or jogging.

U.S. Pat. No. 4,262,435 is directed to an improved athletic shoe and with the sole piece as a wedge to facilitate supporting the runner's foot when contacting the ground.

U.S. Pat. No. 4,614,046 issued to Dassler ("Dassler") describes a shoe which has two low points and not a single low point (FIG. 5 of Dassler). One low point is in the middle to the front of the shoe and the other low point is in the middle to the back of the shoe. There is not a single low point as is preferred by one of the embodiments the inventive shoe. Therefore, the shoe of Dassler would not roll smoothly forward converting energy into useful forward motion while reducing reactive impact force that normally travels back to the leg. There is no suggestion nor teaching in Dassler to have a single low point which would enable the runner to convert this negative energy into positive energy.

U.S. Pat. No. 4,372,059 issued to Ambrose ("Ambrose") discloses a shoe with a single low point (at the line 4—4) in about the center of the sole. The problem that arises with this location of the single low point is that when the heel striker's shoe makes contact with the ground surface at the back end of the shoe, the shoe will try to roll forward, but in reality, will apply a force that may either cause the shoe to roll backwards or cause the user to force the shoe to roll forward being less efficient and generally increasing the possibility of injury to the user. One embodiment of the inventive shoe would provide that when the user lands on the ground surface on the back rear section of the sole of said shoe, the sole would then roll from the rear section to the front section of the shoe smoothly, thereby reducing reactive impact force.

Today, there is a need to make the shoe better by incorporating the concept of "conversion" in the design of the shoe. There is no shoe to date that employs the principle of energy conversion.

SUMMARY OF DESIGN CONCEPT

This invention focuses on energy conversion as a new concept in running shoes. Secondarily it describes a new configuration for the treads and a new, replaceable shock absorber unit. Both are a direct consequence of the basic innovated shoe design.

SUMMARY OF THE INVENTION

An object of this invention is the design and development of the shoe with a rounded heel strike area and gently curved bottom. The user, such as a walker or runner, while engaging in movement would have the shoe make contact with the ground surface and the shoe would roll smoothly forward converting energy in a useful forward motion while reducing the reactive impact force that normally travels back up the leg. The runner would thus be more efficient with simultaneous decrease in injuries due to impact pressures.

The term shoe is used throughout the specification and in some figures specific shoes are mentioned. However, it is to be understood that the term "shoe" includes running shoes, walking shoes, slippers, sandals, thongs and boots.

Another object of this invention is the design and development of modified treads. Since most heel strikers slide or shuffle rather than plant their foot in making first contact to the ground, the treads on the heel and back portion of the shoe should embrace or utilize this fact by making the treads a series of longitudinal grooves much like the grooving of an automobile or airplane tire. In contrast, the forefoot treads should be horizontal grooves or ridges to facilitate the force or gripping of the ground in the push-off of running.

Another object of this invention is the design development of the replaceable shock absorber unit to nestle within the rounded, thickened heel.

Another object of this invention is the design of the shoe that will enable a heel striker to land on the rear section of the sole behind the ankle. When the runner is walking or running, the runner's shoe would land in front of the runner's center of gravity. The sole of the shoe could have a single low point located backwardly of the ankle. When the shoe is resting on a horizontal flat ground surface the front of the shoe can be elevated such that the inner sole would be parallel to the ground surface.

Taking these three components separately and together, this invention will create a shoe to enhance ease, comfort, smoothness, and efficiency while allowing a greater longevity of the product and reducing running injuries.

This invention is directed to a shoe for a human foot comprising a sole piece and an upper piece. The sole piece consists essentially of a front, middle, and rear section with a ground engaging bottom surface. Further, the sole piece will be curved, particularly at the rear permitting the users foot to tilt slightly forward to enhance power during the push-off phase of the stride. The upper piece, secured to the bottom, creates an enclosure to embrace the foot. The upper piece can partially or fully enclose the shoe. If the upper piece fully encloses the shoe it too would have a front or toe box section, a middle and a rear section.

DESCRIPTION OF THE PREFERRED EMBODIMENTS

Figure 1:
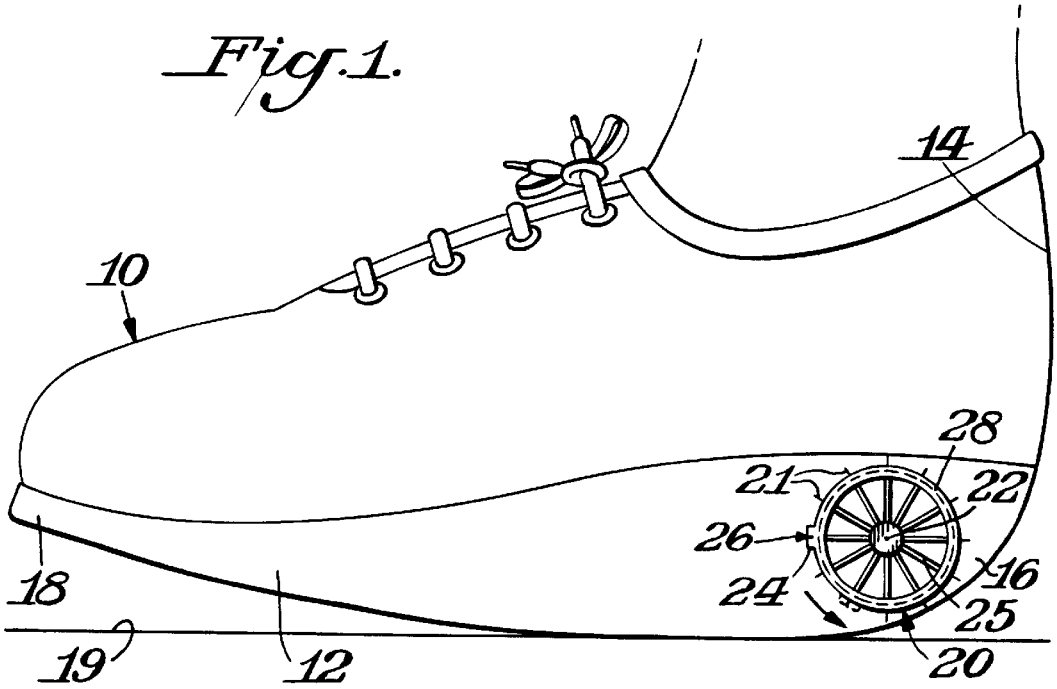
FIG. 1 shows a side elevational view of an embodiment according to this invention.

FIG. 1 shows a side elevational view of a running shoe according to this invention. The running shoe 10 has a sole 12 which would make contact with the ground surface 19. The running shoe 10 has an upper portion 14 that is connected to the sole 12. The sole 12 would have a rounded heel 16 at the rear section of the sole 12 and a toe 18 at the front of the sole 12. The rounded heel 16 would enable a heel-striker to hit on the heel 16 and roll forward on the surface 19 and be able to push-off at the toe 18. The sole 12 of the shoe 10 could have a single low point located at the ankle or backwardly of the ankle on the bottom and back portion of the sole 12. This single low point would be located at the heel 16 of the shoe 10. When the shoe 10 is resting on a horizontal flat ground surface, the inner portion of the shoe 10, in particular, the top of the sole 12 would not be parallel to the ground surface, but would be higher in elevation in the back at the location of the heel 16 and lower in elevation at the front at the location at the toe portion 18. The bottom of the sole 12 would make contact to the ground surface when in use. The top of the sole 12 would be inside the shoe and would not make ground contact but would be in close proximity to the users foot. When viewing the top of the sole 12 (inner sole 12) from the rear of the shoe 10, the inner sole 12 would therefore be angled downward. The runner would have the runner's toes facing to the ground surface while wearing the shoe 10 and not be parallel to the ground surface. On a conventional shoe, the toes of the runner would be parallel to the ground surface and not point towards the ground surface Another words, while the inventive shoe 10 is resting on a flat ground surface, the front of the shoe 10 can be elevated while keeping the heel 16 on the ground surface 19 such that the top of the sole can adjusted to be parallel to the ground surface.

Figure 2:
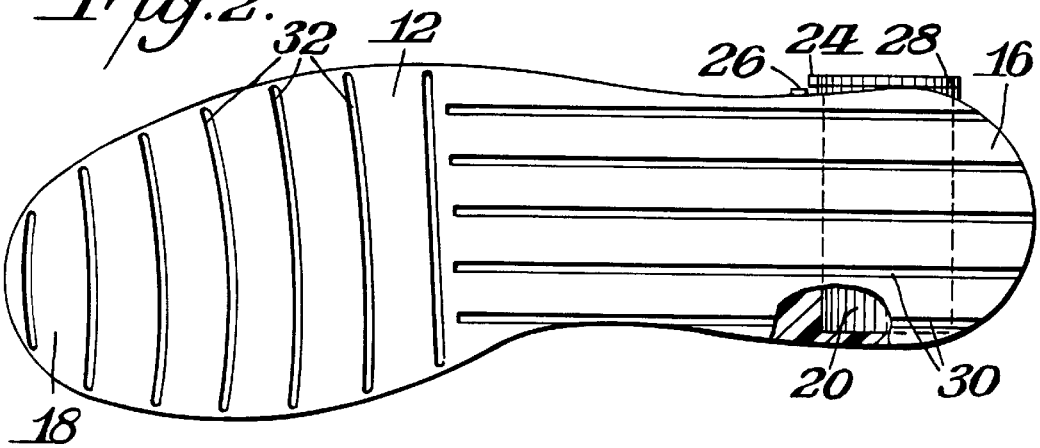
FIG. 2 shows a bottom plan view of the running shoe shown in FIG. 1, showing a sole tread design according to this invention.
Figures 4, 5:
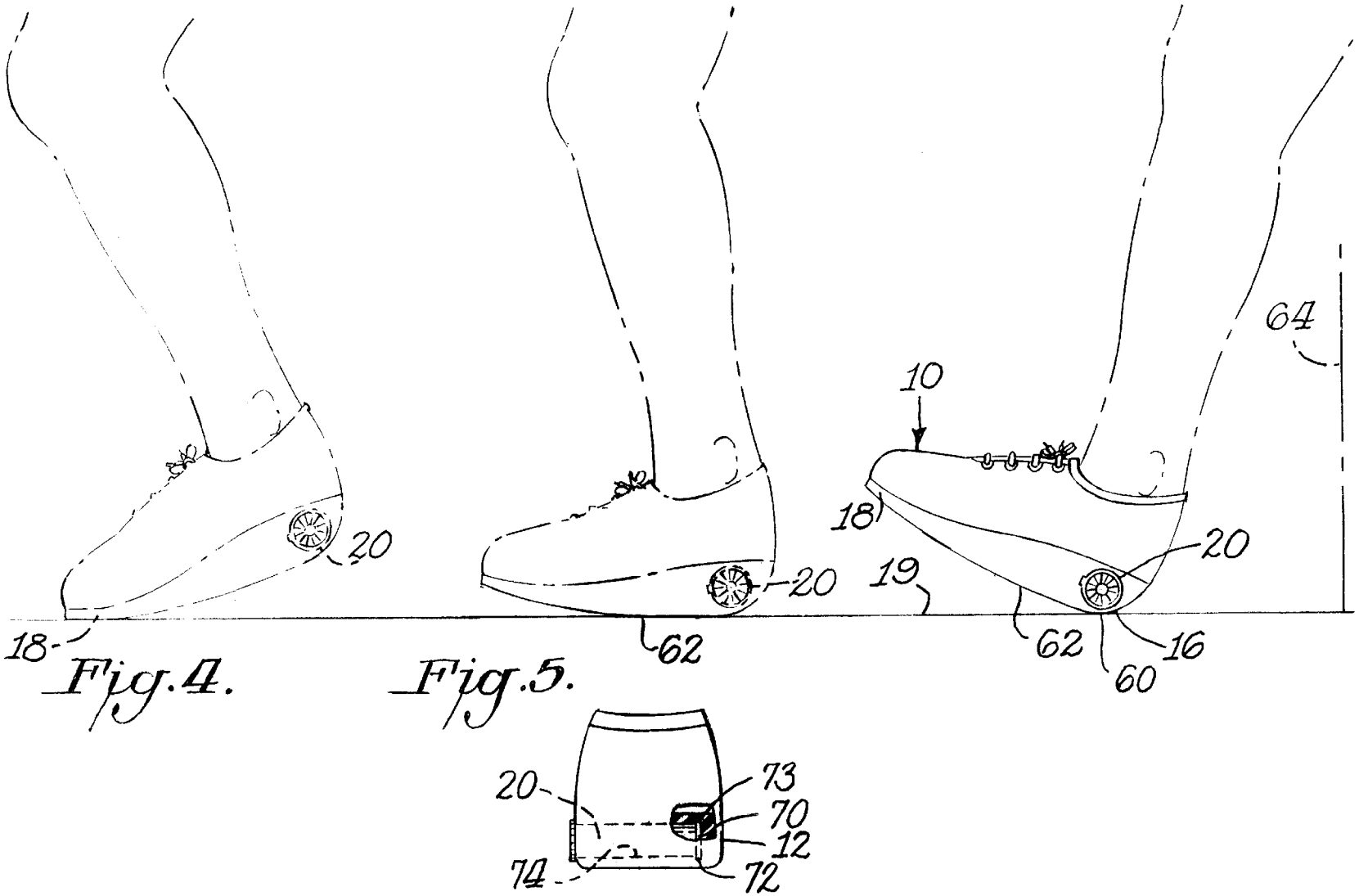
FIG. 4 shows a schematic view showing the running shoe contacting the ground surface with the user's leg as a point of reference.
FIG. 5 shows a back elevational view of the running shoe, shown in FIG. 1, showing an alternative insert located partially through the sole instead of completely through the sole according to this invention

Also it is possible to have a shock-absorbing insert 20 that can be located in the in rear of the sole 12 or above the sole 12 in the rear of the running shoe 10. The insert 20 can be partially through the sole 12 (as shown in FIGS. 1, 2 and 5), such as at least about 50% and preferably at least about 75% and have locking mechanism that enables a user to push the insert 20 into the shoe 10 and the insert 20 would lock into position and would not come out of the shoe when in use. The insert 20 alternatively could go completely through the shoe 10 (being exposed transversely on each side of the running shoe 10). The insert's 20 purpose is to provide a compression device for the running shoe 10. There are a n umber of types of possible inserts 20 that could be used. The insert 20 can have a core 22 in the center. The core 22 can be made of an shock-absorbing material such as, but not limited to a rubber, a rigid foam or a plastic material. The core 22 can be the length of the entire insert 20. Connected to the core 22 can be radial ribs 25. The radial ribs 25 can be made of the same or different material as the core 22. Each radial rib 25 can have one end connected to a casing 28 and can have the other end connected to the core 22.

It is also possible to have a tab 24 connected to the insert 20. An index arrow 26 can be located on the sole 12. Having the tab 24 and the index arrow 26 would make it easier to determine how much the insert 20 is rotated. The user can rotate the insert 20 in increments of about 15° about 180°, preferably from about 15° about 30°, every time the user laces up the shoes. The index arrow 26 will help the user to measure how much the user has rotated the insert 20. For convenience, the running shoe 10 can have marks 21 on the sole 12 or above the sole in the rear of the running shoe 10 such that the marks 21 are located around the outer circumference of the insert 20.

FIG. 2 shows the bottom plan view of the running shoe 10 shown in FIG. 1, showing a sole and tread design. The rear tread 30 would be longitudinally to accommodate the shuffler (a runner who shuffles his feet on the ground instead of picking his feet off the ground) and to maximize the energy of the shoe when it hits the ground surface 19 instead of resisting the shoe 10 when the shoe 10 rolls on the ground surface 19. In sharp contrast, the forefoot treads 32 should be transverse allowing the treads 32 to grip the road surface at the moment of push-off. The forefront treads 32 would be perpendicular to the longitudinal rear threads 30.

Figure 3:
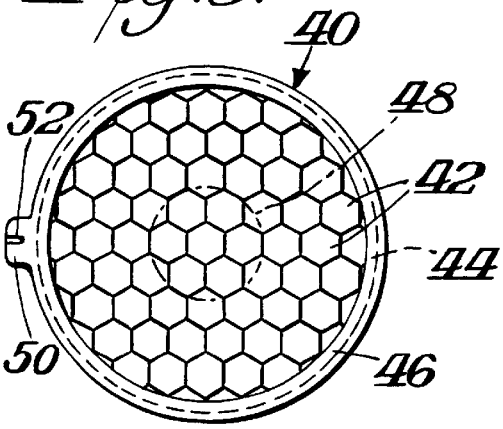
FIG. 3 shows a side elevational view of an alternate compression insert design according to this invention.

FIG. 3 shows a side elevational view of an alternative compression tube insert design. The insert 40 can be removable and replaceable. The insert 40 can be made up of longitudinal hexagonal cells 42. The cells 42 would connect and fit inside a casing 44. There could be an outer flange 46 covering the casing 44. Optionally, there could be a core 48 as is shown in FIG. 3 in phantom. The hexagonal cells 42 can be connected on top of the core 48 and inside the casing 44. If no core 48 is present, then the hexagonal cells 42 can fit one next to the other inside the casing 44. There could be a tab 50 connected to the outer flange 46. Additionally, there could be an index marker 52 located on the rotatable tab 50 to allow easy identification of how much the insert 40 has been rotated on the shoe 10.

FIG. 4 shows the schematic side elevational view showing the running shoe contacting the ground surface with the user's leg as a point of reference. When the shoe 10 strikes the ground surface 19, the outer back bottom of the heel 16 at the rear section 60 of the sole 12 makes contact with the ground surface 19, with the foot simultaneously rolling forward to the toe 18. The rear section of the sole 12 can be divided to a front portion 62 and the rear portion 60. The single low point of the sole 12 would be located at the rear section 60 of the sole 12 (see the portion of FIG. 4 at the far right). The center portion of the FIG. 4 illustrates the shoe 10 rolling forward with the complete or almost complete surface of the sole 12 making contact with the ground surface 19. The left view illustrates the runner then pushing off the toe 18 having a slightly bent knee. Since the knee is slightly bent, the impact energy is thus converted to forward energy or forward thrust, propelling the runner along his way. The design of the shoes, in particular, having an enlarged rounded or curved raised heel portion causes this phenomenon to occur. FIG. 4 illustrates the runner landing on the heel 16 of the shoe 10 being in front the runner's center of gravity 64 and the shoe 10 movement during the course of ground contact.

When the shoe 10 is resting on a level surface, the upper top sole 12 where the foot would rest, would not be parallel to the ground surface like all athletic shoes, but would actually have the heel portion slightly higher in elevation than the toe portion of said inner sole. The back end of the heel on the sole could be curved.

FIG. 5 illustrates a rear elevational view of the insert 20 located in the rear of the sole 12. The insert 20 is shown going partially through the sole 12. There could be a locking mechanism 70 which would enable the user to insert the insert 20 and have the insert 20 lock into place. It is possible that the locking means 70 is the material of the sole 12. Another way to have a locking means 70 is by having a radial groove 72 which is slightly larger in diameter than the diameter of the hole 74 and slightly larger in diameter than the insert 20. The insert 20 could have a radial bead 73 at the end of the insert 20. The diameter of the insert 20 at the bead 73 location would be larger than the diameter of the hole 74. However, the diameter of the insert at the bead 73 would be slightly smaller than the diameter of the radial groove 72. The insert can be forced into position by pushing the insert through the hole. There will be some resistance because the radial bead 73 is greater than the hole 74. This way when the insert 20 would form a snug fit inside the radial bead 73. The insert 20 can still be rotatable and removable.

Figure 6:
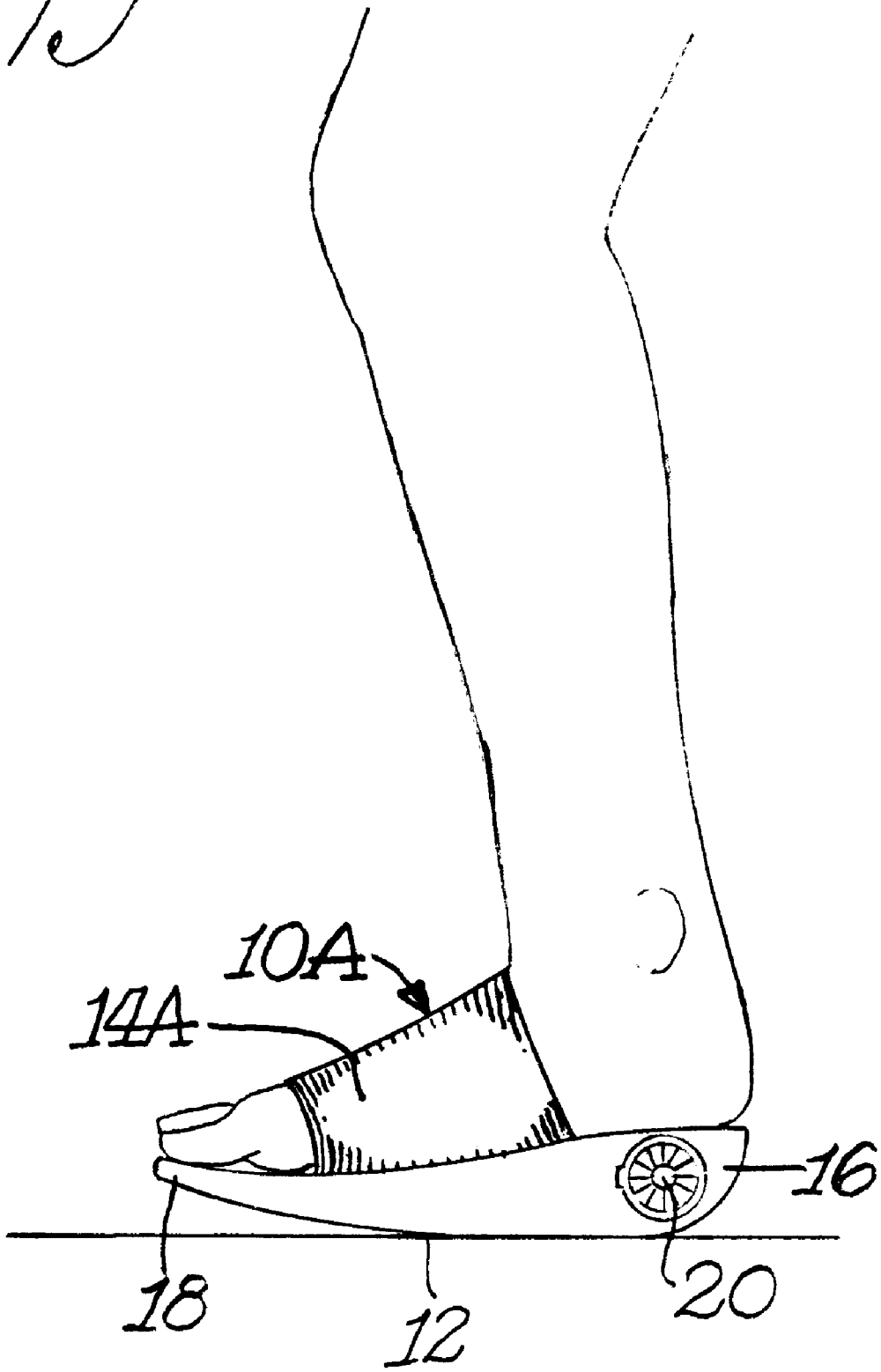
FIG. 6 shows a side elevational view of another shoe according to this invention.

FIG. 6 shows a side elevational view of another shoe according to this invention. The shoe can be a sandal, thong, slipper etc. The user's toes could also be covered although that it is not shown in FIG. 6. The shoe 10A has a sole 12 which would make contact with the ground surface. The shoe 14A has an upper portion 14 that is connected to the sole 12. The upper portion can be a strap if the shoe is a sandal or thong or partial enclosed material as shown in FIG. 6 if the shoe is a sandal or slipper. The sole 12 would have a rounded heel 16 at the rear section of the sole 12 and a toe 18 at the front of the sole 12. The rounded heel 16 would enable a heel-striker to hit on the heel 16 and roll forward on the surface 19 and be able to push-off at the toe 18. The sole 12 of the shoe 10 could have a single low point located at the ankle or backwardly of the ankle on the bottom and back portion of the sole 12. This embodiment would be similar to the embodiment shown in the previous figures except that the upper portion 14 that is connected to the sole 12 does not completely enclose the sole 12.

The shoe can be fully enclosed like the conventional running or walking shoe. The shoe can be partially enclosed like a sandal or slipper. The shoe can also be in the shape of a conventional thong and have a strap connected to the sole and would enable the user's foot to securely fit inside the strap and the sole. The strap could be located on the sole to fit between a user's big toe and second toe. The strap would also go on top of the user's foot to keep the thong secured to the user's foot.

Summary of the advantages of the shoe are as follows:

(1) The Rounded Heel Strike Area

As the heel makes contact with the ground surface, the foot instantaneously rolls forward. The impact energy is thus converted to forward energy or forward thrust, propelling the runner along his way. This is an energy saving device that simultaneously reduces the jolt directed back up the leg under the law of equal and opposite forces. This configuration would lessen discomforts and injuries while making the runner more efficient and faster.

(2) The Push-off

In both walking and running a person normally plants the heel, rolls forward on the outer portion of the foot, then pushes off with toes and fore foot. The push-off provides the drive or energy to propel the body forward. The new shoe with rounded and raised heel flows easily into gently sloping mid-foot and fore-foot. Inside the shoe, the foot itself is tilted ever so slightly forward enhancing the power of push off (similar to the sprinter running on his toes).

(3) The Treads

Most people are heel-strikers and shuffle making contact with the ground. The treads should be designed on the heel area to utilize this fact. The tread should be grooved longitudinally to accommodate the shuffler. They should not be configured into miscellaneous swoops and swirls which is so common in running shoes today. The treads should look like the major grooving in automobile and airplane tires. This visual analogy gains further strength in knowing the rounded heel is specifically designed to roll the foot forward. In sharp contrast, the fore foot treads should be transverse allowing the treads to grip the ground at the moment of push off.

(4) Cylindrical Shock Absorber

Running shoes wear out, treads erode, heels loose cushioning, and the fore foot goes flat. To prolong the life of the shoe, it is possible to have an insert replacement shock absorber within the heel. The insert can extend from side to side for the full width of the heel area. The insert can be constructed to allow rotation. The runner could rotate the insert about 15–20 degrees every time the runner puts on the shoes. This would eliminate repeated pounding on exactly the same spot; thereby, extending the life of the cushioning. The cushioning can also be constructed as removable. The runner can remove the insert, reverse it and reinsert it. When the cushioning or insert is worn out the runner would remove it and can than replace it with a fresh unit.

More cushioning could be added to the fore foot because of the greater thickness of the shoe. With this combination of techniques to moderate impact pressures (conversion, compression/absorption, and dispersion) the bottom surface could relinquish any responsibility as a shock adsorbate. Just make it thin and worldly tough such as using KEVLAR a trademarked product which is a high-strength aramid.

This inventive design of the shoe, deploys a conversion of energy, a new tread pattern, and a cylindrical cushioning unit that could be both rotated and replaced. Variations with these three concepts is endless. The rounded profile of the shoe could well vary to the height and stride length of the runner, with flat versus hilly country, with short versus long run/races, etc. Different tread configurations would surely emerge. It would also be possible for the insert to be a configuration of hexagonal shaped cells made up of compressible material such as the honeycombed shape constructed by bees.

The shoes are designed to redirect impact forces that slow progress and cause injuries. The principles involved would also be applicable to walking. Since the new shoe conserves energy it theoretically should be faster for longer races than sprints.

The inventive running shoe is helpful in reducing the assault of impact pressures on the body, by the conversion and dissipation of energy.

The shoe would have the feature that said bottom surface of said sole piece from said rear section to said front section has a single low point located on a smooth continuous surface at the heel of said rear section of said sole piece to assure elevation of the heel, whereby when said shoe is worn by a user said sole at said rear section at the back end of said rounded sole piece makes initial contact with a ground surface, at a contact point at the rear end of said sole piece and the contact point of said sole piece rolls in a smooth continuous motion to said front section thereby reducing the reactive impact force. This feature would permit the user to change the user's style of running by converting the negative energy (force going back into the runner's legs upon ground contact) into positive energy thereby propelling the runner forward and eliminating most or all of the force going back into the runner's leg. The shoe is most effective for a heel striker since the heel striker lands on the heel of the shoe and the shoe permits the heel striker to roll the heel forward and thereby creating positive energy.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described.

I claim:

1. A shoe for a dynamic human foot comprising a sole piece having a front section where a user's fore foot would be located, a middle section and a rear section where the user's heel would be located, said rear section has a front end and a middle end and a back end, said front end is connected to said middle section of said sole piece, said sole piece having a ground engaging bottom surface and an upper surface on which the user's foot is received and, an upper piece secured to said sole piece, said upper piece providing an embracing foot enclosure enclosing the user's toes, and said bottom surface of said sole piece is rounded at said back end of said rear section at the sole piece and elevated at the rear section of said sole piece and when said shoe is resting on a flat surface, said upper surface of the sole piece where the foot would rest would not be parallel to the flat surface and would have said rear section slightly higher in elevation than said front section of said sole piece so that when the user inserts the user's foot the toes of the user's foot face towards the flat surface and are not parallel with the flat surface, said bottom surface of said sole piece having a continuous curved surface from said rear section to said front section, said bottom surface of said sole piece has a single low axis transverse the sole at said rear section located on the continuous curved surface forwardly of said back end of said rear section of said sole piece when said bottom surface is on the flat surface upon initial contact with the flat surface to assure elevation of the heel when said single low axis of said bottom surface is in contact with the flat surface so that the entire remaining bottom surface forwardly of the single low axis transverse the sole would be tilted upwardly from said rear section to said front section, whereby when said shoe is worn by a user said sole piece at said rear section at the back end of said rounded sole piece makes initial contact with a flat surface, said initial contact being at a contact axis at the rear end of said sole piece and the contact axis of said sole piece rolls in a smooth continuous motion from said rear section rolling to said middle section rolling to said front section along said continuous curved bottom surface thereby creating energy conversion means to reduce the reactive impact force, and when said shoe can be resting on a flat surface, the front end of said shoe is elevated such that said upper surface of said sole piece is parallel to said flat surface while keeping the rear section of said shoe on said flat surface.

2. The shoe as claimed in claim 1, wherein said sole piece has a width, and said ground engaging bottom surface of said sole piece has a transverse tread design at the front section of said sole piece on said bottom surface and said tread lies transverse to the length of said sole piece along a longitudinal line of the sole.

3. The shoe as claimed in claim 1, wherein said sole piece has a length, and said ground engaging bottom surface has a longitudinal tread design at the rear section of said sole piece on said bottom surface and said longitudinal tread lies parallel to the length of said sole piece along a longitudinal line of the sole.

4. The shoe as claimed in claim 2, wherein said sole piece has a length, and said ground engaging bottom surface has a longitudinal tread design at the rear section of said sole piece on said bottom surface and said longitudinal tread lies parallel to the length of said sole piece along a longitudinal line of the sole.

5. The shoe as claimed in claim 1, wherein a shock absorber insert is located in said upper surface of the sole piece in said rear section thereby supplying more cushioning to the rear of said shoe, and said shock absorber insert being about the same length as the width of said rear section of said sole piece where said shock absorber insert is located.

6. The shoe as claimed in claim 4, wherein a shock absorber insert is located in said upper surface of the sole piece in said rear section, thereby supplying more cushioning to the rear of said shoe, and said shock absorber insert being about the same length as the width of said rear section of said sole piece where said shock absorber insert is located.

7. The shoe as claimed in claim 6, wherein said shock absorber is removable.

8. The shoe as claimed in claim 7, wherein said shock absorber is rotatable.

9. The shoe as claimed in claim 8, wherein said shock absorber insert is a cylindrical shape and said insert located in said rear section above said bottom surface of said sole piece, thereby located inside said sole piece and not making contact with said ground surface.

10. A method of exercising comprising a user wearing a pair of shoes as claimed in claim 1, and the said user lands on the rear section of said sole piece of said shoe, and pushes off the ground surface with said front section of said sole piece.

11. A method of prolonging the life of a shoe comprising a user wearing a pair of shoes as claimed in claim 6, and said user adjusting the shock absorber insert by turning said shock absorber insert prior to use thereby eliminating the repeated pounding on exactly the same spot of said insert.

12. The shoe as claimed in claim 1, wherein said bottom surface of said sole piece is made from a high-strength aramid.

13. The shoe as claimed in claim 1, wherein a hole is located partially through said upper sole piece surface in the rear section above the bottom surface and below the top surface of said sole piece, said hole would go across the shoe, from inside of said sole piece to the outside of said sole piece.

14. A shoe for a human foot which comprises a sole piece having a front section where a user's fore foot would be located, a middle section and a rear section where the user's heel would be located, and having a ground engaging bottom surface and an upper surface in which the wearer's foot is received, and an upper piece secured to said sole piece, said upper piece providing an embracing foot enclosure, a shock absorber insert located in a hole in the upper piece in the rear section above the bottom surface of said sole piece, thereby located inside said sole piece and not making contact with said ground surface and said shock absorber insert thereby supplying more cushioning to the rear of said shoe, and said shock absorber insert being at least 50% of the width of said rear section of said sole piece at the location where said shock absorber insert is located, and said shock absorber insert has a radial bead at one end of said insert, and said insert has a diameter less than the diameter of the hole, and the diameter of the insert at the bead is larger than the diameter of the hole in said sole piece, and the diameter of the insert at bead being smaller than a radial groove inside said sole piece.

15. The shoe as claimed in claim 14, wherein said ground engaging bottom surface of said sole piece has a transverse tread design at the front section of said sole piece and said tread lies transverse to the length of said sole piece along the longitudinal line of the sole and said ground engaging bottom surface has a longitudinal tread design at the rear section of said sole piece and said longitudinal tread lies parallel to the length of said sole piece along the longitudinal line of the sole.

16. The shoe as claimed in claim 14, wherein said shock absorber is rotatable and removable and is at least about 75% of the width of said upper end of said sole piece.

17. The shoe as claimed in claim 14, wherein said shock absorber insert is a cylindrical shape.

18. The shoe as claimed in claim 14, wherein said shock absorber is rotatable in increments of about 15 to about 30°.

19. A shoe for a dynamic human foot comprising a sole piece having a front section where a user's fore foot would be located, a middle section and a rear section where the user's heel would be located, said rear section has a front end and a middle end and a back end, said front end is connected to said middle section of said sole piece, said sole piece having a ground engaging bottom surface and an upper surface on which the user's foot is received and, an upper piece secured to said sole piece, said upper piece providing an embracing foot enclosure enclosing the user's toes, and said bottom surface of said sole piece is rounded at said back end of said rear section at the sole piece and elevated at the rear section of said sole piece and when said shoe is resting on a level surface, said upper surface of the sole piece where the foot would rest would not be parallel to the ground surface and would have said rear section slightly higher in elevation than said front section of said sole piece so that when the user inserts the user's foot the toes of the user's foot face towards the ground surface and are not parallel with the ground surface, said bottom surface of said sole piece having a continuous curved surface from said rear section to said front section, said bottom surface of said sole piece has a single low axis transverse the sole at said rear section located on the continuous curved surface forwardly of said back end of said rear section of said sole piece when said bottom surface is on the ground surface upon initial contact with the ground surface to assure elevation of the heel when said single low axis of said bottom surface is in contact with the ground surface forwardly of the single low axis transverse the sole so that the entire remaining bottom surface would be tilted upwardly from said rear section to said front section, whereby when said shoe is worn by a user said sole piece at said rear section at the back end of said rounded sole piece makes initial contact with a ground surface, said initial contact being at a contact axis at the rear end of said sole piece and the contact axis of said sole piece rolls in a smooth continuous motion from said rear section rolling to said middle section rolling to said front section along said continuous curved bottom surface thereby creating energy conversion and reducing the reactive impact force and when said shoe is resting on a flat surface, the front end of the shoe can be elevated such that inner sole would be parallel to said ground surface while keeping the rear section of said shoe on said flat surface, and an insert located in said upper surface of said sole piece and selectively alignable indicia on said insert and on the sole piece around said insert.

* * * * *